US007187338B2

(12) United States Patent
Boyle et al.

(10) Patent No.: US 7,187,338 B2
(45) Date of Patent: Mar. 6, 2007

(54) ANTENNA ARRANGEMENT AND MODULE INCLUDING THE ARRANGEMENT

(75) Inventors: Kevin R. Boyle, Horsham (GB); Peter J. Massey, Horley (GB)

(73) Assignee: NXP BV, Eindhoven (NL)

( * ) Notice: Subject to any disclaimer, the term of this patent is extended or adjusted under 35 U.S.C. 154(b) by 0 days.

(21) Appl. No.: 10/513,505

(22) PCT Filed: Aug. 29, 2003

(86) PCT No.: PCT/IB03/01868

§ 371 (c)(1),
(2), (4) Date: Nov. 4, 2004

(87) PCT Pub. No.: WO03/096475

PCT Pub. Date: Nov. 20, 2003

(65) Prior Publication Data

US 2005/0237251 A1 Oct. 27, 2005

(30) Foreign Application Priority Data

May 9, 2002 (GB) ..... 0210601.1

(51) Int. Cl.
*H01Q 13/10* (2006.01)

(52) U.S. Cl. ..... 343/770; 343/846

(58) Field of Classification Search ..... 343/770, 343/767, 846, 702, 700 MS, 860
See application file for complete search history.

(56) References Cited

U.S. PATENT DOCUMENTS 5,365,246 A * 11/1994 Rasinger et al. ..... 343/702
5,835,063 A 11/1998 Brachat et al. ..... 343/700 MS
6,031,503 A 2/2000 Preiss, II et al. ..... 343/770
6,052,093 A 4/2000 Yao et al. ..... 343/770
6,175,334 B1 1/2001 Vannatta et al. ..... 343/702
6,507,322 B2 * 1/2003 Fang et al. ..... 343/770
2002/0126052 A1 * 9/2002 Boyle ..... 343/702

FOREIGN PATENT DOCUMENTS

WO WO0171843 A2 9/2001
WO WO0171843 A3 9/2001
WO WO0213306 A1 2/2002
WO WO02095869 A1 11/2002

* cited by examiner

*Primary Examiner*—Hoang V. Nguyen
*Assistant Examiner*—Ephrem Alemu

(57) ABSTRACT

An antenna arrangement includes aground conductor (302) incorporating two slots (304*a*,304*b*) having an electrically small separation and connections (308*a*,308*b*) for coupling a transceiver to each slot to enable the ground conductor to function as two substantially independent antennas. Such a device enables efficient diversity performance to be obtained from small volume. The ground conductor, slots and transceiver are integrated in a module (206) adapted for connection to a further ground conductor which provides the majority of the antenna area. The further conductor would typically be a printed circuit board ground plane or mobile phone handset. Matching and broadbanding circuitry may conveniently be incorporated in the module. By varying the area of the connections between the module and the further ground conductor, the resonant frequencies of the slots can be modified.

9 Claims, 4 Drawing Sheets

ANTENNA ARRANGEMENT AND MODULE INCLUDING THE ARRANGEMENT

This application is the U.S. national stage application of international application PCT/IB03/01868, filed Aug. 29, 2003, which claims priority of United Kingdom patent application No. 0210601.1 filed on May 9, 2002.

The present invention relates to an antenna arrangement comprising a ground conductor and means for coupling a transceiver to the ground conductor, and further relates to a radio module comprising the transceiver and the antenna arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Hence, because of the limits referred to above, it is not feasible to achieve efficient wideband radiation from small antennas in present-day wireless terminals.

A further problem with known antenna arrangements for wireless terminals is that they are generally unbalanced, and therefore couple strongly to the terminal case. As a result a significant amount of radiation emanates from the terminal itself rather than the antenna. A wireless terminal in which an antenna feed is directly coupled to the terminal case, thereby taking advantage of this situation, is disclosed in our International patent application WO 02/13306. When fed via an appropriate matching network the terminal case, or another ground conductor, acts as an efficient, wideband radiator. A modification of this arrangement in which the antenna feed is coupled to the terminal case via a slot is disclosed in our pending International patent application WO 02/95869 (unpublished at the priority date of the present invention).

In many applications it is desirable for a wireless terminal to have two independent antennas, to enable the use of antenna diversity techniques. However, known antenna diversity arrangements typically occupy a significant volume in order for the antennas to have sufficient electrical separation to provide uncorrelated signals.

An object of the present invention is to provide a compact antenna diversity arrangement for a wireless terminal.

According to a first aspect of the present invention there is provided an antenna arrangement comprising a ground conductor incorporating two slots having an electrically small separation and means for coupling a transceiver to each slot, thereby enabling the ground conductor to function as two substantially independent antennas.

The diversity performance of the arrangement may be optimised by arranging for the slots to be substantially orthogonal (by which it is meant, in the case of slots having one open end, that portions of each slot which are a similar distance (measured along the slot) from their respective open ends are substantially orthogonal). It may also be optimised by applying capacitive loading to the slots and applying a different phase shift between the transceiver and each slot. The electrically small separation will typically be less than half a wavelength at operational frequencies of the arrangement.

According to a second aspect of the present invention there is provided a radio module comprising a ground conductor incorporating two slots having an electrically small separation, a transceiver, means for coupling the transceiver to each slot and means for coupling the ground conductor to a further ground conductor, thereby enabling the combination of the ground conductor and the further ground conductor to function as two substantially independent antennas.

Embodiments of the present invention will now be described, by way of example, with reference to the accompanying drawings, wherein.

In the drawings the same reference numerals have been used to indicate corresponding features.

Our International patent application WO 02/13306 discloses an antenna arrangement in which the case of a wireless terminal, or another ground conductor forming part of the terminal, is fed via an appropriate matching network and acts as an efficient, wideband radiator.

Figure 1:
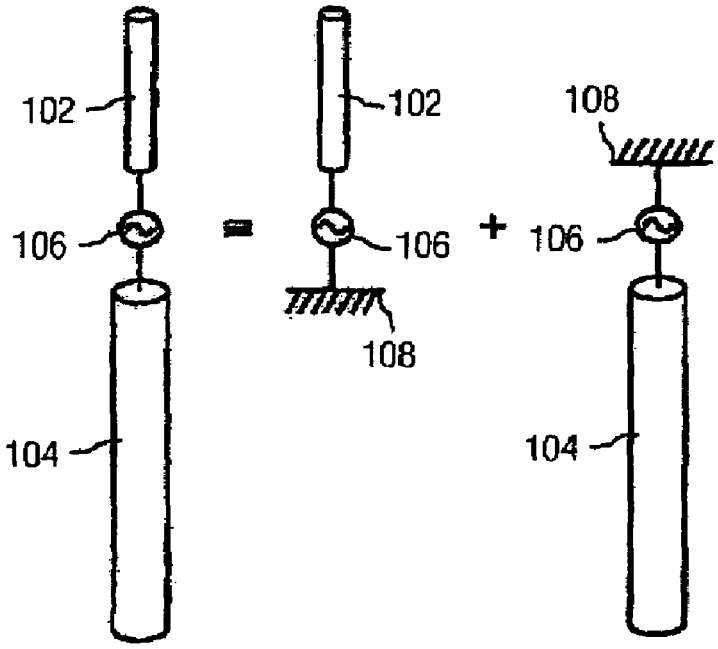
FIG. 1 PRIOR ART
FIG. 1 shows a model of an asymmetrical dipole antenna, representing the combination of an antenna and a wireless terminal.

In summary, it was shown in WO 02/13306 that the combination of an antenna and a wireless terminal (for example a mobile phone handset) can be regarded as an asymmetrical dipole. FIG. 1 shows such a model of the) impedance seen by a transceiver, in transmit mode, in a wireless handset at its antenna feed point. The first arm 102 of the asymmetrical dipole represents the impedance of the antenna and the second arm 104 the impedance of the handset, both arms being driven by a source 106. As shown in the figure, the impedance of such an arrangement is substantially equivalent to the sum of the impedance of each arm 102,104 driven separately against a virtual ground 108. The model is equally valid for reception when the source 106 is replaced by an impedance representing that of the transceiver.

It was also shown in WO 02/13306 that the antenna impedance could be replaced by a physically-small capacitor coupling the antenna feed to the handset. In one embodiment the capacitor was a parallel plate capacitor having dimensions of 2×10×10 mm on a handset having dimensions of 10×40×100 mm. By careful design of the handset, the resultant bandwidth could be much larger than with a conventional antenna and handset combination. This is because the handset acts as a low Q radiating element (simulations show that a typical Q is around 1), whereas conventional antennas typically have a Q of around 50.

A problem with the use of a parallel plate capacitor to couple a transceiver to a ground plane is that it requires a significant volume (even if this volume is much less than that needed for a PIFA). As part of the current trend towards ever-smaller wireless terminals, low-profile modules are being developed including the RF circuitry required for a device (such as a mobile phone or Bluetooth terminal). Such modules are typically shielded by being enclosed in a metallic container, although such shielding is not always necessary. The addition of a capacitor plate of the dimensions indicated above can more than double the volume occupied by such a module by doubling its height, which is undesirable.

Figure 2:
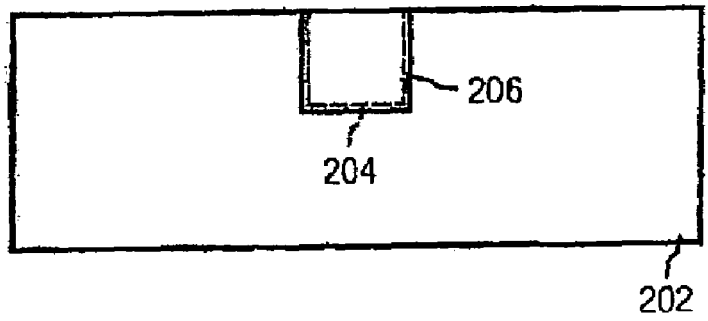
FIG. 2 PRIOR ART
FIG. 2 is a plan view of a Radio Frequency (RF) module mounted on a ground conductor.
Figure 3:
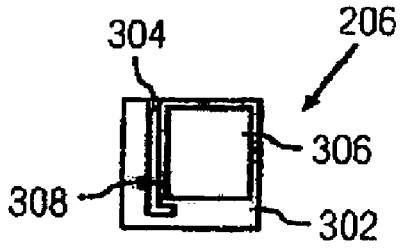
FIG. 3 PRIOR ART
FIG. 3 is a plan view of an RF module comprising a slotted ground plane.

This problem was solved, as disclosed in our pending International patent application WO 02/95869, by feeding RF power from a transceiver to a ground plane across a slot in the ground plane. This arrangement is illustrated with reference to FIGS. 2 and 3, which are respectively plan views of a RF module mounted on a ground conductor and of an RF module comprising a slotted ground plane. An RF module 206 is mounted on a Printed Circuit Board (PCB) having a rectangular ground plane 202 with a rectangular cut-out 204 (shown dashed). The module 206 also comprises a ground plane 302, having dimensions slightly larger than the cut-out 204 to enable the two ground planes 202,302 to be electrically connected. The module's ground plane 302 incorporates a slot 304 which is approximately a quarter wavelength long at the operational frequency of the module 206. The module includes RF circuitry 306 (not shown in detail) and a connection 308 to the side of the slot 304 remote from the RF circuitry.

In operation as a transmitter, power from the RF circuitry 306 is fed across the slot and thence to the ground planes 302,202. In operation as a receiver, RF signals received by the ground planes 302,202 are extracted by means of the slot 304 and fed to the RF circuitry 306. Although such a feeding arrangement does not provide such a wide bandwidth as the capacitive coupling described in WO 02/13306, the arrangement still provides a wide bandwidth compared to conventional antennas, and the trade-off between volume and bandwidth will be appropriate for many applications.

The slot 304 may, as illustrated, be folded around the RF circuitry 306. It can be designed so that its resonant frequency is principally determined by the quarter wave slot resonance, while its bandwidth is determined by the combination of slot 304 and ground planes 302,202. Integration of the slot 304 in the module 206 enables tuning of its resonant frequency by varying the connections between the module's ground plane 302 and the PCB ground plane 202. Although the cut-out 204 in the PCB ground plane 202 is shown as being rectangular and of a similar size to the module 206, this is not essential. The only requirement is that the cut-out 204 is such that there is no metallisation on the PCB immediately beneath the slot 304 (and in practice that the cut-out 204 is larger than the slot 304 by at least as much as production tolerances and alignment errors, so that the effective slot dimensions are determined by the dimensions of the slot 304 in the module 206, and not by the dimensions of the cut-out 204). The location of the module 206 at the edge of the PCB, as shown, is convenient since the module is relatively remote from the remaining circuitry on the PCB but it remains straightforward to make connections to the module.

Figure 4:
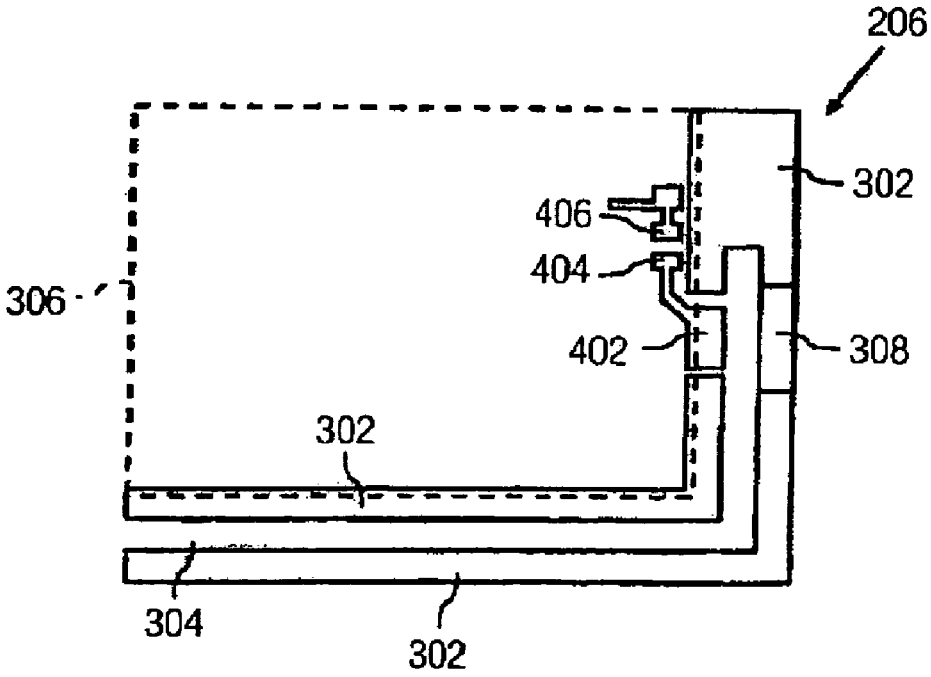
FIG. 4 PRIOR ART
FIG. 4 is a plan view of a practical embodiment of an RF module.

FIG. 4 shows a plan view of a production embodiment of a RF module 206 having overall dimensions of approximately 15×13 mm. This embodiment is manufactured by Philips Semiconductors, having a product number BGB100A, and is intended for use in Bluetooth applications. An L-shaped ground conductor 302 incorporates an L-shaped slot 304. The slot is fed via a 1.5 nH inductor connected to connection points 402,308 and a 3 pF series capacitor connected to connection points 404,406. Further matching circuitry comprising a 1.3 nH series inductor and a 1.8 pF shunt capacitor is connected between the series capacitor and a 50Ω feed. Other RF circuitry 306, not shown, is included in the area enclosed by the dashed lines. This circuitry includes a plurality of ground connections so that, when mounted on a PCB, substantially the whole of the area enclosed by the dashed lines can be considered as ground conductor.

Figure 5:
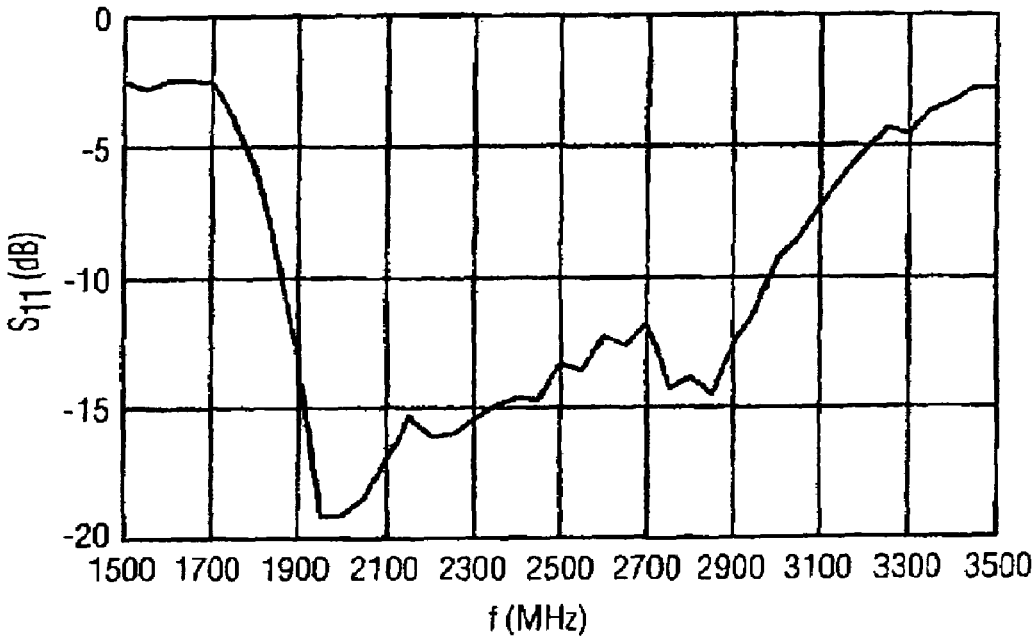
FIG. 5 PRIOR ART
FIG. 5 is a graph of measured return loss $S_{11}$ in dB against frequency f in MHz for the RF module shown in FIG. 4.

In this embodiment the PCB ground plane is close to a half wavelength in dimension, resulting in good bandwidth. FIG. 5 is a graph of measured return loss $S_{11}$ of the module of FIG. 4, in each case for frequencies between 1500 and 3500 MHz. The module 206 was mounted with the slot 304 opening onto the long edge of a PCB having dimensions 100×40 mm, the module being located 25 mm from the short edge of the PCB. The efficiency is greater than 80% and the return loss greater than 10 dB over a bandwidth of more than 1 GHz from 1900 to 2900 MHz. Link test measurements have demonstrated adequate performance over a distance in excess of 10 m, thereby meeting the requirements of the Bluetooth specification.

The present invention improves on the arrangement described above by providing two independent modes of operation, thereby enabling the ground planes 202,302 to function as if they were two independent antennas. In conventional antenna diversity arrangements provision of a diversity arrangement would require two antennas separated by a significant fraction of a wavelength, and could not therefore be provided in a compact module 206 such as that described above. However, in a module made in accordance with the present invention, a diversity arrangement is possible in such a small area.

Figure 6:
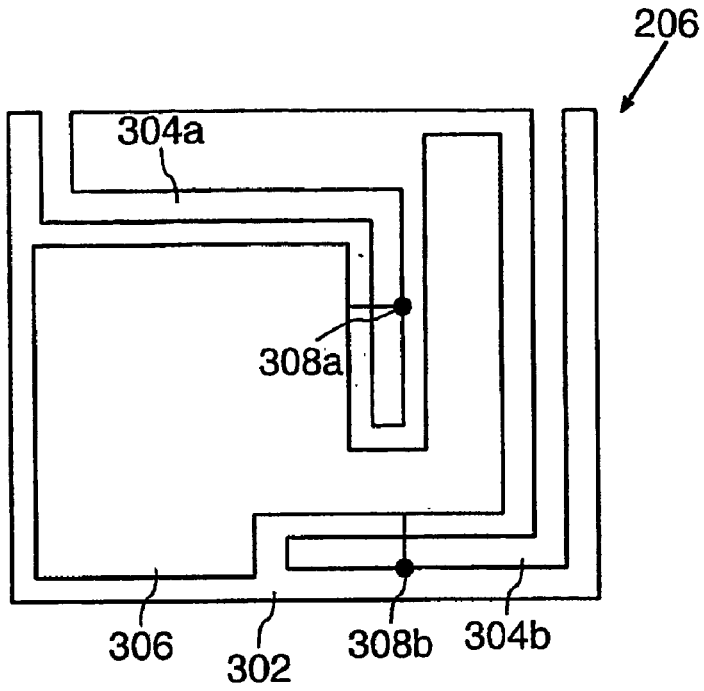
FIG. 6 is a plan view of an RF module comprising a ground plane having two substantially orthogonal slots.

FIG. 6 is a plan view of a first embodiment of a module 206 made in accordance with the present invention, the module comprising a ground conductor 302 and first and second slots 304*a*,304*b*. The slots 304*a*,304*b* are configured to be substantially orthogonal to one another at the same field/current points, i.e. at corresponding points along their length measured from their open ends. This is most critical at the shorted ends of the slots 304*a*,304*b*, where the largest unopposed currents are found. As a result of this orthogonality, each slot sets up different current distributions on the PCB ground plane 202, leading to different radiation and polarisation patterns and therefore independent reception of multipath components. Hence, signals transmitted or received via each slot are substantially uncorrelated.

The module 206 includes RF circuitry 306, which can occupy the area of the module not taken up by the slots 304*a*,304*b*. In operation, power from the RF circuitry 306 is fed across the slots to respective connection points 308*a*, 308*b* on the sides of the slots 304*a*,304*b* remote from the bulk of the RF circuitry 306. For Bluetooth applications, the module 206 could be of similar size to that shown in FIG. 4, with each of the slots 304*a*,304*b* having a length similar to that in the FIG. 4 embodiment. While the slots 304*a*,304*b* should be approximately a quarter of a wavelength long in principle, the presence of the module substrate allows this to be reduced to perhaps 20 mm (at 2.4 GHz).

Figure 7:
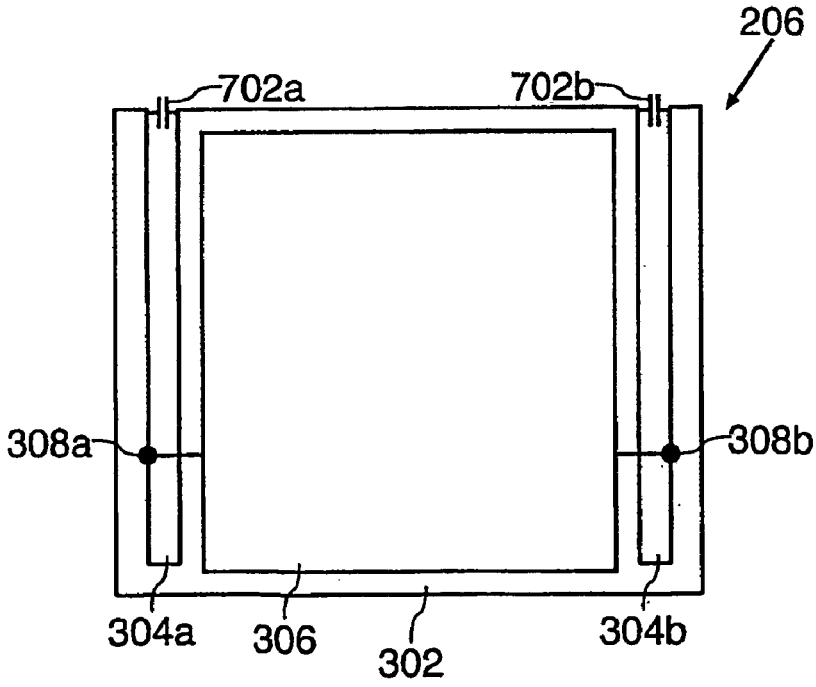
FIG. 7 is a plan view of an RF module comprising a ground plane having two parallel, capacitively loaded slots.

An alternative arrangement is shown in FIG. 7, which is a plan view of a second embodiment of a module 206 made in accordance with the present invention. In this embodiment the slots 304*a*,304*b* are loaded by respective capacitors 702*a*,702*b*, which allows them to be shortened while maintaining the same resonant frequency. This allows the slots 304*a*,304*b* to be separated as far as possible within the footprint of the module 206, although this still represents a separation of only a tenth of a wavelength for the Bluetooth module referred to above. The cross-correlation between transmitted or received signals from each slot can be further reduced by appropriate phasing of the signals from each slot. The required phase shifts can be achieved by a variety of techniques including discrete phase shifting circuits, hybrid couplers, and switched parasitic loading.

Selection of suitable phasing for dipole antennas is discussed in our pending International patent application WO 01/71843. However, the techniques presented there are not directly applicable to the present invention because it relates to dipole antennas rather than slots, and also because in embodiments of the present invention the slots 304*a*,304*b* share a common ground conductor 202,302.

Combinations of these two methods (orthogonal and capacitively-loaded slots) may be used to give diversity that is dependent on space, polarisation and radiation patterns (all of which are inter-related with such small slot separations). In this way, diversity can be achieved from a very small space, such as that available in an antenna-enabled RF module.

In some applications, dual band antennas may be required for use in multi-standard wireless communication equipment. Typical combinations are Bluetooth or IEEE 802.11b (WiFi) at 2.4 GHz and IEEE 802.11a at 5 GHz. Both of the IEEE standards support diversity. Dual band performance can be achieved by feeding the slots 304*a*,304*b* at single points and using dual band matching networks. However, in embodiments such as those presented above where the slots are contained within the radio module, it is advantageous to feed each slot 304*a*,304*b* at two different points and provide isolation via a multiplexing (switch or filter) network. Choosing the low frequency feed point to be close to an electric field null of the high frequency feed point can further enhance this isolation. For example, the low frequency feed point could be close to the shorted ends of the slots 304*a*, 304*b* and the high frequency feed point closer to the open ends.

In addition to the polarisation diversity resulting from different current flow patterns in the ground conductors 302,202 in the embodiments shown in FIGS. 6 and 7, further polarisation diversity can be achieved in any embodiment by using slots 304*a*,304*b* (as described above) in conjunction with a conventional PIFA. The antennas can be located within the same volume (a very small RF module) but have substantially different polarisations. This is because the slots 304*a*,304*b* are embedded in the PCB rather than being fed against it. The PIFA will have the polarisation of the PCB, while the polarisation of the slots 304*a*,304*b* will depend on their orientation within the PCB. This can be arranged to provide orthogonality, which can be at least partially achieved without modification of the PIFA or slots. If the two antennas couple too strongly a switch may also be provided across the slots when the PIFA is receiving.

As described above, the slots 304*a*,304*b* can either be incorporated into the ground plane 302 of an RF module 206 or a PCB ground plane 202. In the latter case, the RF components may or may not be provided in the form of a module 206. An advantage of incorporating the slots 304*a*, 304*b* in the module 206 is that the feeds can be more precisely controlled, while matching, bandwidth broadening and/or multi-band operation can be realised in a well-controlled manner. It can be seen that there are significant advantages in fabricating an integrated module, which can then be connected to a PCB ground plane for improved radiation performance.

References above to an RF module 206 do not preclude the inclusion of other non-RF components in a module, such as for example baseband and device control circuitry. In the embodiments shown above, the slots 304*a*,304*b* were open-ended. However, slots closed at both ends can equally well be used if fed in a balanced manner.

From reading the present disclosure, other modifications will be apparent to persons skilled in the art. Such modifications may involve other features which are already known in the design, manufacture and use of radio communications devices and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

The invention claimed is:

1. An antenna arrangement comprising a ground conductor including two straight slots which are substantially parallel throughout their lengths and have an electrically small separation, capacitive loading being applied to each of the slots; and means for coupling a transceiver to each slot, wherein the ground conductor functions as two substantially independent antennas.

2. An arrangement as claimed in claim 1, wherein one end of each slot is open.

3. An arrangement as claimed in claim 1 or 2, wherein means are provided for applying a different phase shift between the transceiver and each slot.

4. An arrangement as claimed in claim 1 or 2, further comprising a planar inverted-F antenna, wherein the polarizations of the ground conductor and the planar antenna are significantly different.

5. A radio module comprising a ground conductor including two straight slots which are substantially parallel throughout their lengths and have an electrically small separation, a transceiver, means for coupling the transceiver to each slot and means for coupling the ground conductor to a further ground conductor, wherein the ground conductor and the further ground conductor function as two substantially independent antennas.

6. A module as claimed in claim 5, wherein coupling means are provided for varying the connection area between the ground conductor and further ground conductor, thereby altering the operational frequency of the module.

7. A module as claimed in claim 5 or 6, wherein the transceiver is adapted for dual-band use and in that the means for coupling the transceiver to each slot comprises first and second connections to each slot, the first connection for use in a first frequency band and the second for use in a second frequency band.

8. An arrangement as claimed in claim 5, wherein the further ground conductor is a printed circuit board ground plane.

9. An arrangement as claimed in claim 5, wherein the further ground conductor is a handset case.

* * * * *